US006072400A

United States Patent [19]

Johnson et al.

[11] Patent Number: 6,072,400

[45] Date of Patent: Jun. 6, 2000

[54] SMART ELECTRONIC MUZZLE REFERENCE LIGHT SOURCE

[75] Inventors: Mark A. Johnson, Rensselaer; Paul J. Cote, Clifton Park, both of N.Y.

[73] Assignee: The United States of America as represented by the Secretary of the Army, Washington, D.C.

[21] Appl. No.: 09/368,466

[22] Filed: Jul. 15, 1999

Related U.S. Application Data

[60] Provisional application No. 60/106,497, Nov. 2, 1998.

[51] Int. Cl.[7] ..... G08B 3/00

[52] U.S. Cl. ..... 340/691.1; 42/1.02; 42/70.06; 42/70.07; 89/14.05; 73/1.67

[58] Field of Search ..... 340/691.1; 89/74.05; 73/167; 42/1.02, 70.06, 70.07

[56] References Cited

U.S. PATENT DOCUMENTS

| | | | |
|---|---|---|---|
| 5,142,805 | 9/1992 | Horne et al. | 42/1.02 |
| 5,487,234 | 1/1996 | Dragon | 42/70.07 |
| 5,953,844 | 9/1999 | Harling et al. | 42/70.06 |

*Primary Examiner*—Jeffery A. Hofsass
*Assistant Examiner*—Tai T. Nguyen
*Attorney, Agent, or Firm*—John F. Moran; Michael C. Sachs

[57] ABSTRACT

An electronic light source which replaces the hazardous tritium light source used in the existing Muzzle Reference System (MRS) found on the M1 Series of tanks. The MRS is mounted near the muzzle end of the gun (opposite the breech) and is used by tank gunness to measure gun deflection for calibration of the tank's fire control computer to optimize accuracy. The electronic light source is an LED which is activated by the pulses from a microcontroller based on the input received from a small, low power, omnidirectional motion sensor which detects the movement of the tank mounted on the tank. In the current implementation, the motion sensor comprises a conductive rolling sphere in a cylindrical chamber having a conductive wall with one electrical pole and end plates electrically insulated from the conductive wall and having the other electrical pole such that movement of the element caused by movement of the cylinder will generate intermittent electrical contact between one end plate and the cylinder wall. The signals produced are fed to the microcontroller which through the operation of its oscillator energizes the LED. The oscillator frequency is selected to eliminate EMI detection. The activation of the LED is prepared in such a manner to extend battery lite by minimizing power drain, a thermometer is employed for temperature control of the LED and other electronic circuit elements.

5 Claims, 4 Drawing Sheets

SMART ELECTRONIC MUZZLE REFERENCE LIGHT SOURCE

This application claims benefit of filing date Nov. 2, 1998 of provisional application No. 60/106,497, the entire file wrapper contents of which application is herewith incorporated by reference as though fully set forth herein at length.

GOVERNMENT INTEREST

The invention described herein may be manufactured, used, or licensed by or for the U.S. Government for U.S. Government purposes.

BACKGROUND OF THE INVENTION

1. Field of Invention

This invention applies to the field of systems and for apparatus which are used as monitoring devices attached to the muzzle end of large caliber guns (opposite breech) for use in measuring gun deflection for calibration purposes. Moreover the invention includes the field of low power, omnidirectional, motion sensors capable of detecting low magnitude vibrations. Lastly, the field of the invention encompasses use of electronic light sources which are used to replace radioluminescent sources such as tritium.

2. Background of the Invention

The specific problem solved by this invention is one of replacing the hazardous tritium light source used in the existing Muzzle Reference System (MRS) found on the M1 series of tanks. However, the invention also applies to any type of artillary where muzzle deflection must be measured. The Muzzle Reference System (MRS) is mounted near the end of the gun (opposite the breech) and is used by tank gunners to measure muzzle deflection for calibration of the fire control computer.

The light source is required when the ambient light is inadequate for accurate measurements. The existing light source in the Muzzle Reference System uses a radioluminescent source, tritium, for illumination. The costs associated with the acquisition, handling and disposal of tritium are high. It is estimated that the Army will save approximately $71M over 10 years by replacing tritium with an electronic light source. Such an action would also eliminate a hazard with the high costs of acquiring, handling and disposing of the tritium that has existed for many years.

Various efforts have been made in the past to solve this major problem with electronic light sources. For example a traditional battery operated light source could be used to replace the tritium based Muzzle Reference System (MRS). Typically, a MRS is used only for minutes out of each year and traditional battery operated devices cannot exploit this fact. The capacity of the battery is constrained by the internal dimensions of the existing MRS (1 inch diameter×0.68 inch height) and requires replacement twice per year under continuous operation for the specified LED intensity.

Incorporating an ON/OFF switch into any design is unacceptable because of potential damage to any external wiring and the dangers to the crew associated with operating an externally switched MRS in combat. Maintaining electrical contact with the battery terminals is a major problem given the environmental extremes under which the MRS must operate. In addition, the costs and environmental hazards associated with disposing of tens of thousands of batteries every year are very high. Furthermore, since the Light Emitting Diode (LED) is always active in traditional designs, the entire Muzzle Reference System unit, including the housing must be replaced every five (5) years due to the limited life of the LED.

In U.S. Pat. No. 5,523,742 by Thomas E. Simkins and Mark Johnson, issued on Jun. 4, 1996; U.S. Pat. No. 5,610,590, also by Thomas E. Simkins and Mark Johnson, issued Mar. 11, 1997 entitled, MOTION SENSOR, a motion detection device is described comprising a sensor for providing signals in response to patient movements.

These issued patents embody a sensor which includes a conductive rolling sphere in a cylindrical chamber, having an interior portion locating the sphere therein with conductive end plates and conductive inner surfaces such that movement of the element caused by movement of the cylinder will generate intermittent electrical contact between one end plate and the cylinder wall thus generating the ability to generate an alarm or movement signal for further processing.

Accordingly, it is an object of this invention, using as an element the motion sensor concept embodied in U.S. Pat. Nos. 5,523,742 and 5,610,590 to provide a device which senses when a gun is in use and which automatically powers down when not in use during extended periods of inactivity.

Still another object of this invention is to allow the electric power provided by a battery to the device to have an extended life of an estimated twenty (20) years. Such a battery life would exceed the service life of the guns.

Yet, another object of this invention is to eliminate the required replacement of the electronic light source mounted in the device due to its minimum on time, therefore making MRS housing replacement unnecessary.

Finally, another object of this invention is to allow the battery of the device to be permanently hardwired to the electronics, eliminating the contact problems associated with units that use replaceable batteries.

Other objects will appear hereinafter.

SUMMARY OF INVENTION

It has now been discovered that the above and other objects of the present invention may be accomplished in the following manner. Specifically, the invention comprises an omnidirectional motion sensing detection device which triggers the illumination of an LED only when the gun is in use and automatically powers down during extended periods of inactivity. Any low power, omnidirectional motion sensor capable of withstanding the ballistic forces and environmental extremes that exist at the muzzle end of a gun tube could be used to detect gun motion. The device known as the Smart Electronic Reference Light Source employs a sensor that satisfies these requirements. It consists of a switch that comprises a small, electrically conducting sphere that is able to move within the confines of a small, hollow cylinder with end cap closures. The wall of the cylinder is conductive as are the end caps, each of which is separated from the cylinder wall by an insulator. The end caps are electrically connected and form one pole of the switch. The cylinder wall forms the other pole. When the sphere is in contact with either of the end plates and the cylinder wall, the switch is electrically closed.

The output of the sensor is used by the electronics to determine when the tank is active. The sensor drives a microcontroller. When no sensor activity is detected, the microcontroller enters a power saving, non-oscillatory, sleep-mode drawing minimal current. When movement is detected, the processor "wakes up" and illuminates an LED. The system then shuts down again until it detects further motion. The LED can be supplied with a constant DC voltage. As an option, battery drain in the active mode is further reduced by optionally pulsing the LED using "flicker-noise" concepts and optimum selection of the operating frequency of the processor oscillator circuit.

BRIEF DESCRIPTION OF THE DRAWINGS

For a more complete understanding of the invention, reference is hereby made to the drawings which.

DETAILED DESCRIPTION OF PREFERRED EMBODIMENT

Figure 1:
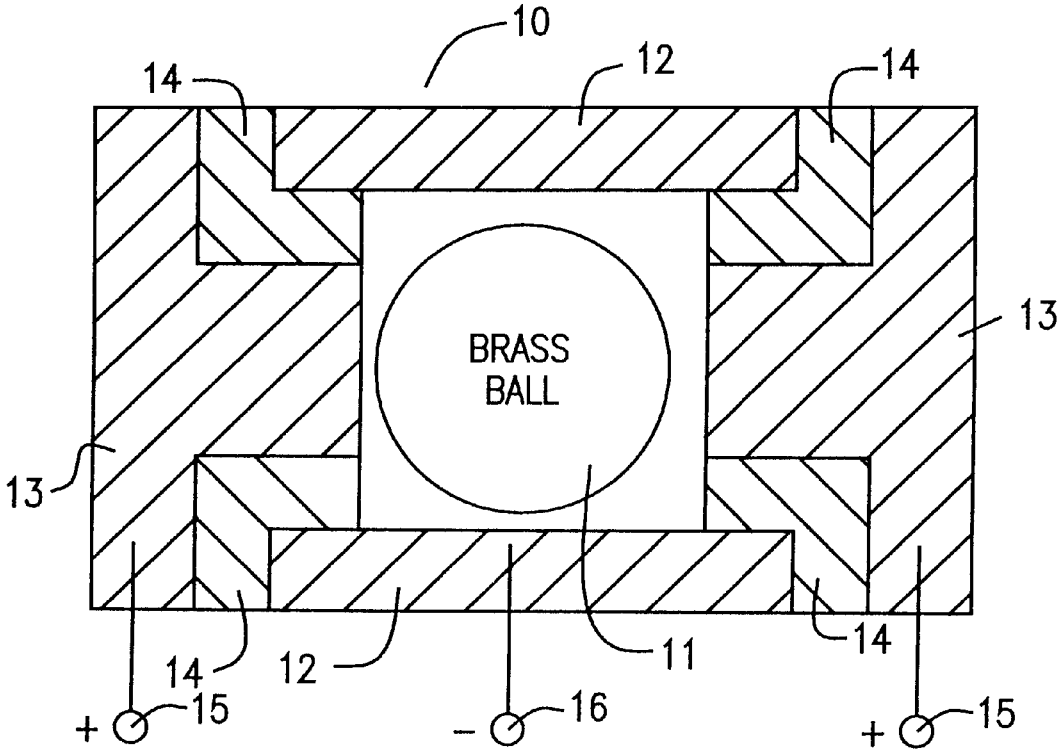
FIG. 1 is a cross-section view of the sensing element in this invention.
Figure 2A:
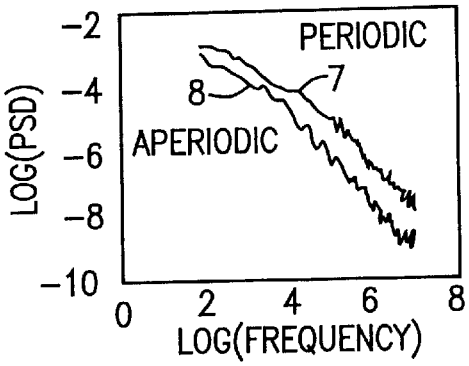
FIGS. 2A–2D are a series of graphs which depict the power spectra typical of the sensor response to a variety of periodic and aperiodic motions.
Figure 2B:
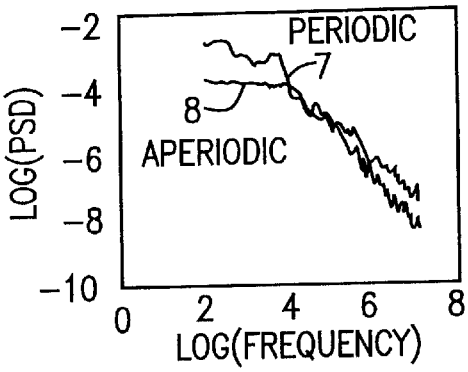
Figure 2C:
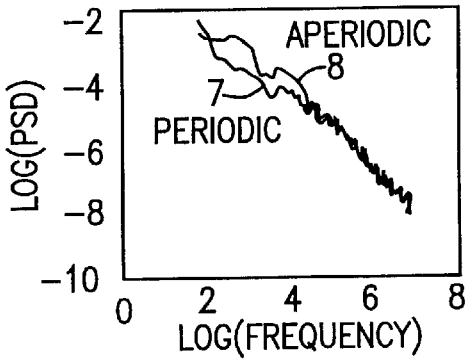
Figure 2D:
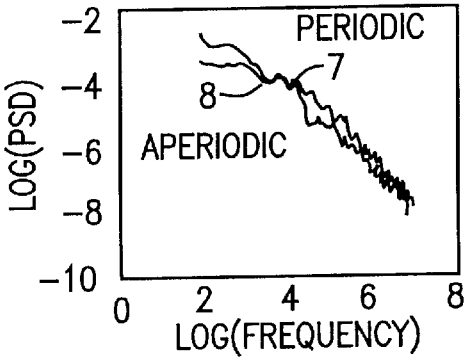

Shown in FIG. 1 is the cross-section of the sensing element 10. The sensing element 10, which is in essence a switch, consists of a small, electrically conducting sphere 11 that is able to move within the confines of a small, hollow conducting cylinder 12 with end cap closure 13. The sphere 11 clearance is 0.017 and ϕ 0.093. The wall of the cylinder 12 is conductive as are the end caps 13, each of which is separated from the cylinder wall 12 by an insulator 14. The end caps 13 are electrically connected and form one pole 15 of the switch 10. The cylinder wall 12 forms the other pole 16.

When the sphere 11 is in contact with either of the end plates 13 and the cylinder wall 12, the switch 10 is mechanically closed. However, the contact resistance determines if the switch 10 is electrically closed. As the sphere 11 rolls, electrical contract with the wall 12 is intermittent, producing a time varying electrical signal. The sensor 10 was selected because of its extremely small size, absence of hazardous components (i.e. Mercury), low power requirements, omni-directional response, high signed to noise ratio, shock resistance, and ability to operate from −60° C. to 140° C. (i.e. Mercury freezes at −38° C.)

FIG. 2 shows four graphs representative of the power spectra typical of the sensor 10 response to a variety of periodic 7 and aperiodic 8 motions. The power spectra have the form of "flicker-noise" associated with many natural phenomenon and would be hidden in the background noise of EMI detectors.

Figure 3:
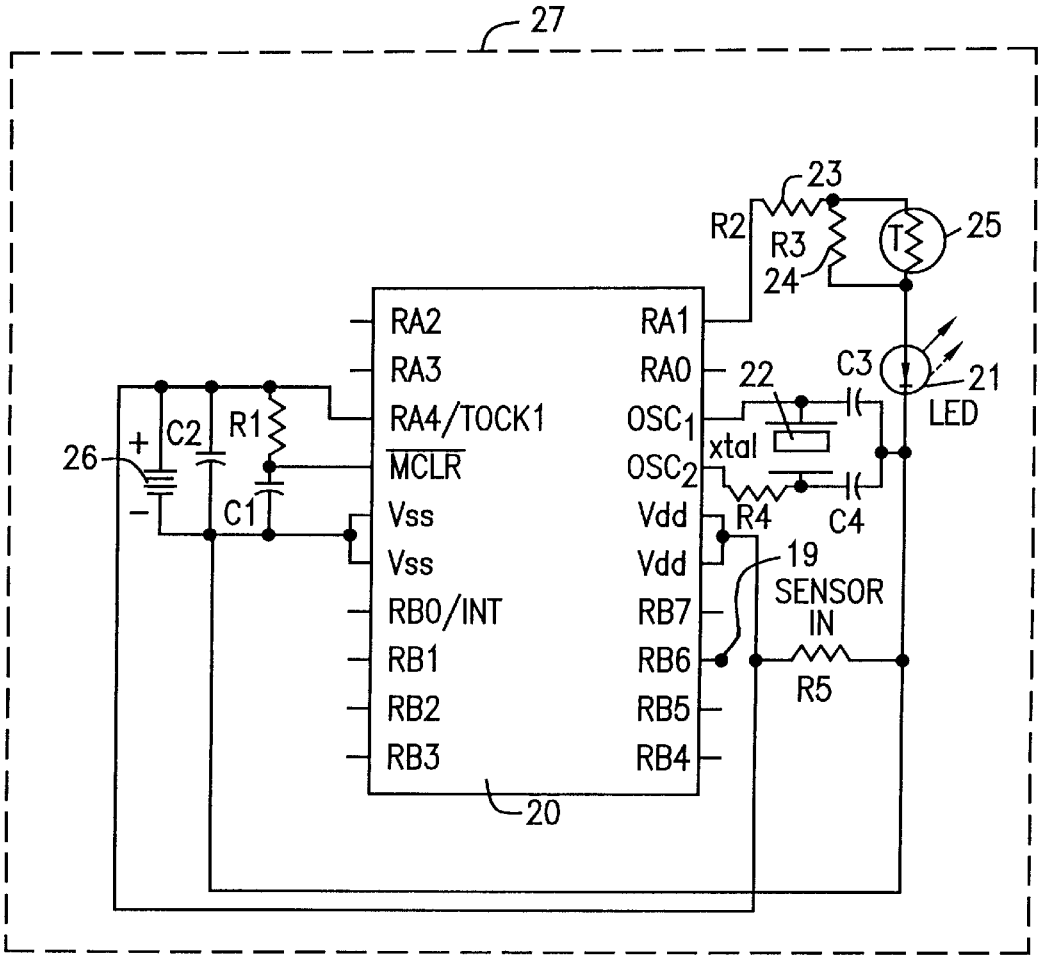
FIG. 3 is a circuit diagram of the present electronics of the invention, illustrating the preferred embodiment into which the sensor output is fed into as part of the Muzzle Reference System represents. It represents the prototype of the SEM-RLS.

FIG. 3 shows the circuit diagram with its various components which is driven by the electrical outputs from the sensor 10, which are fed into it. In particular the sensor 10 drives an input port 19 of a micro-controller 20 where operation is governed by the software given in the code listing. Eighty-four (84) lines of microcontroller code define the system of operation. Presented below at TABLE 1 is the code listing.

TABLE 1

CODE LISTING

```
; bcf STATUS,5=>selects Special Function Registers in Bank 0 (PORTA,PORTB)
; bsf STATUS,5f=>selects Special Function Registers in Bank 1 (TRISA, TRISB, OPTION)
; general purpose registers are in 20h->7Fh in Bank 0 & A0h->BFh in Bank 1
; to minimize power:
;       1.) all unused I/O ports set to outputs
;       2.) don't use portb pull-ups
;       3.) TMRO to Vdd or Vss
;       4.) don't use power-up timer (requires RC timer)
;
RADIX       DEC
PROCESSOR PIC16C558
#include <P16c558.inc>
MINUTES equ 20h
SECONDS equ 21h
M_CNT equ 1
S_CNT equ 125
;       RA0 = output (digital)
;       RA1 = output (actual LED driver)
;       RA2 = output
;       RA3 = output
;       RA4 = output
;
;       RB0 = output
;       RB1 = output
;       RB2 = output
;       RB3 = output (input if battery monitor used-battery monitor (0 = low))
;       RB4 = output
;       RB5 = output
;       RB6 = input (sensor input, digital high = .36 Vdd)
;       RB7 = output
;
;       Vss = ground – Vpp;
;       Vdd = 3.0 Vde
origin org      h'0000'         ;start program here
        goto    start
        goto    start           ;location 0001
```

TABLE 1-continued

CODE LISTING

```
        goto    start       ;location 0002
        goto    start       ;location 0003
;       interrupt service routine (0004)
        clrf    INTCON          ;clear RB port change interrupt &
                                mismatch (0 & 3)
        return                  ; don't enable GIE, or the 'flicker' will be
                                interrupted
start   clrf    INTCON
        clrf    STATUS      ;clear upper three bits (see book)
        bsf     STATUS,5    ;set RP0 to use bank 1 for TRISA, TRISB, and
OPTION
        clrf    TRISA           ;PORTA all outputs
        movlw   b'01000000'     ;PORTB I/O (ONLY BIT 6=input)
        movwf   TRISB
        movlw   b'11100000'     ;ensure portB pull-ups are disabled for RB6
        movwf   OPTION_REG
        bcf     STATUS,5        ;clear RPO to go back to bank 0
        movlw   b'11111101'     ;all outputs high except RA1 (LED)
        movwf   PORTA           ;turn off LED
        movlw   b'11111111'
        movwf   PORTB
        movlw   b'10001000'     ;execute code inline on PORTB interrupt.
        movwf   INTCON
        sleep                   ;sleep until sensor change
        movfw   PORTB           ;end mismatch condition - Must do on16C558
        movlw   M_CNT
        movwf   MINUTES
        movlw   S_CNT
        movwf   SECONDS
loop    call    FLICKER
        decfsz  SECONDS
        goto    loop
        decfsz  MINUTES
        goto    loopl
        goto    start
loopl   movlw   S_CNT
        movwf   SECONDS
        goto    loop
FLICKER
;
        bcf     PORTA,1
#include        <mrs.inc>
;       mrs.inc is comprised of a series of bsf and bcf operations on PORTA bit 1. It provides
;       aperiodic pulsing; to the LED. The code continuously sets the bit and immediately
;       resets it again for a pseudo-random time period before setting it again. ;It is coded
        inline for speed. Ensure LED is OFF when; looping to minimize "flicker effect"
        bcf     PORTA,1
        return
END
```

The preferred embodiment incorporates a Shrink Small Outline Package (SSOP) PIC16LC558 for the microcontroller 20. When no sensor 10 activity is detected, the microcontroller 20 enters a power saving, non-oscillatory 'sleep-mode', drawing only 0.7 $\mu$A of current. When movement is detected, the processor 20 'wakes-up' and illuminate 5 the LED 21 for three minutes. The microcontroller 20 then shuts down again until there is further tank motion. In the current implementation, battery 26 drain in the active mode is further reduced by optimally pulsing the LED 21. "Flicker-noise" concepts are used to efficiently pulse the LED 21, while generating a virtual undetectable EMI spectral signature. The microcontroller 20 pulses the LED 21 aperiodically or so-called flicker pulsing 26 in lieu of periodic pulsing 27 resulting in the power spectrum comparisons shown at FIG. 4. DC power for the LED is an option if minimal power consumption is not a requirement.

Figure 4:
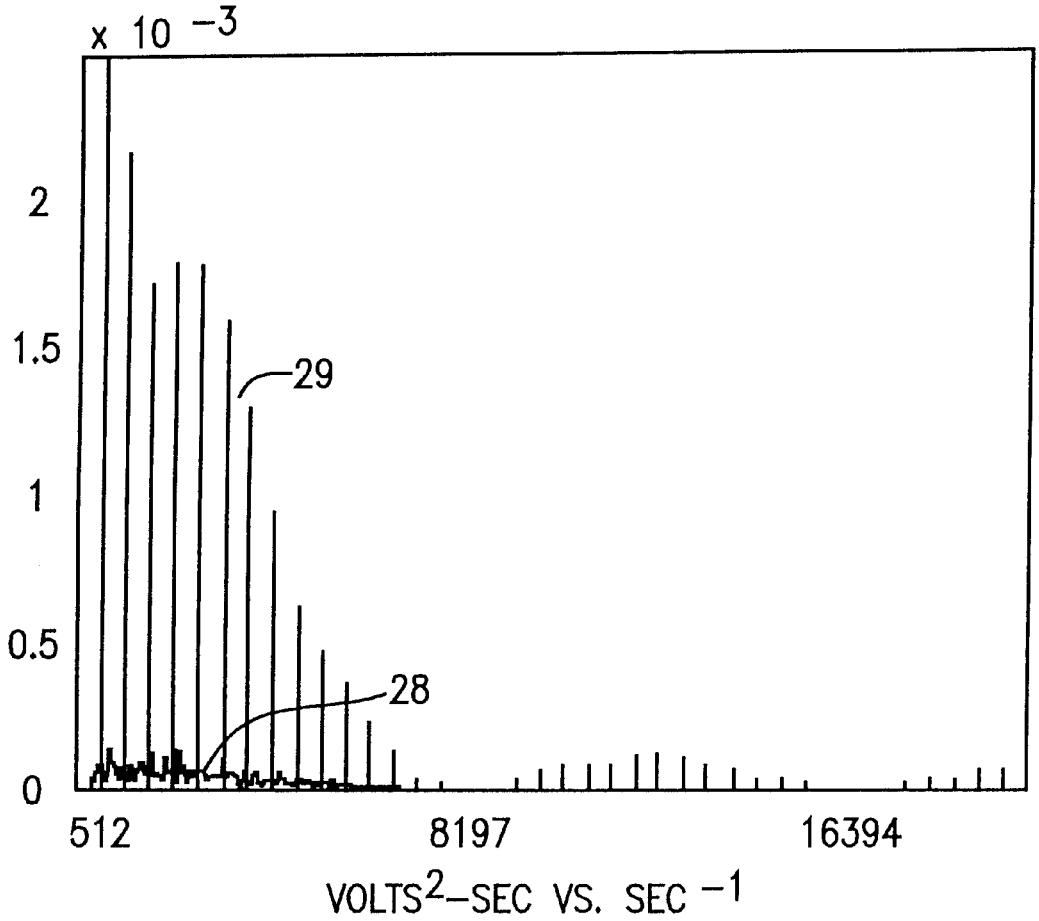
FIG. 4 shows the resulting power spectra when the processor pulses the LED aperiodically or in a "flickering" mode in contrast to periodic pulsing.

FIG. 4 clearly demonstrates the benefits of using aperiodic pulsing 28 when an inconspicuous power spectrum is necessary in comparison to periodic pulsing 29.

In an effort to further conserve battery 26 life and to ensure the oscillator 22 circuit at FIG. 3 applied in the microprocessor 20 cannot be detected, the operating frequency has been selected to be 32.768 KHZ. This is the frequency of crystals used in common quartz watches and has an associated wavelength of 9155 meters. The long wavelength, low power, common oscillator frequency, and metal housing in which the processor 20 is contained, ensure the EMI signature of the oscillator 22 cannot be detected. Although flicker pulsing 28 27 as shown at FIG. 4 is electrically and optically efficient, the effect as battery 26 life is not as significant as the savings associated with powering down the electronics of the circuit 27 of FIG. 3 for extended periods of time.

FIG. 3 is the circuit diagram 27 of a prototype developed consistent with the preferred embodiment for the Smart Electronic Muzzle Reference Light Source (SEMRLS). This size of this entire circuit 27 is 0.8 square inches. The sequence of manufacturing operation for the SEMRLS is simply to encase the sensor 10 electronics 27 at FIG. 3, and battery 26 in the cell assembly of the Muzzle Reference System (MRS) and fill voids with resin. The prototype 27 illuminates the LED 21 for three minutes without pulsing (DC). This requires a minor change to the Software listed above and an increase in R2 23 R3 24 of FIG. 3. A Negative Temperature Coefficient (NTC) thermistor 21 shown at FIG. 3 in a parallel and series combination of resistors 23, 24 is used to compensate for the temperature effects on the battery 26, electronic components and LED 21 efficiency over the temperature range the unit is required to operate. The thermistor 21 dramatically reduces LED 21 current at low temperature while allowing greater currents at higher temperatures. The result is a more uniform LED 21 intensity over the required operating temperature range of −40° C. to 125° C.

The valves used in the prototype circuit are as follows: R1=27 KΩ R2=470Ω, R3=10 kΩ, R4=0Ω. R5=1 mΩ, C1=22 pF, C2=0.01 μF, C3=87 μF, C4=68 μF, xtal=32.768 kHz, and T1=10 kΩ.

The above parameter provided adequate LED 21 illumination in a pulsed active mode and resulted in a 38 μA current draw at room temperature. The estimated lite of a 3 volt Panasonic Coin Cell Battery (model BR2477/1 HF) using components with these valves is approximately 20 years. Hence, the electronics of the circuit 27 shown at FIG. 3 can be permanently hardwired to the battery 26 terminals.

Thus, it is apparent that in accordance with the present invention, a functional design that fully satisfies the objectives aims and advantages is set forth above. While the invention has been described in conjunction with a specific embodiment, it is evident that many alternatives, modifications and variations will become evident to those skilled in the art in light of the foregoing description. Accordingly, it is intended that the present invention embrace all such alterations, modifications, and variations as fall within the spirit and broad scope of the appended claims.

What is claimed is:

1. A lighting device for use in a muzzle reference system which attaches to the muzzle end of a large caliber gun for use in measuring gun deflection for optimizing accuracy comprising:

a small, low power, omnidirectional motion sensor which detects the movement of a gun and which mounts within the muzzle reference system;

a microcontroller to receive and process electronically the outputs of the said motion sensor;

said microcontroller including means to minimize detection of operating signals means to provide-power saving modes and further including means to compensate for temperature effects;

an electronic light source to receive the DC signal or pulsed signal from the said microcontroller which provides the requisite illumination to the muzzle reference system.

2. The lighting device of claim 1 wherein the motion sensor comprises:

an electrically conductive hollow cylinder means, capped at each end respectively by an electrically conductive circular plate which is electrically insulated from said cylinder means, whereby said plates and said cylinder means are connected through an electronic circuit means to a direct current voltage source such that both plates are of the same polarity but opposite to the polarity of said cylinder means;

an electrically conductive ball placed within said cylinder being free to roll, said ball being able to establish a closed electrical path at either end of the cylinder means through contracting the interior surface of either one of said end cylinder plates while also contacting the interior surface of said cylinder means, whereby changes in electrical resistance over a multitude of contacted points of the interior surfaces of the cylinder means and of the circular plate contacted are detected in said microcontroller as a series of electrical current makes and breaks, and as changes in the level of electrical current flow through said microcontroller as the conducting ball moves while making such closed electrical path, through even slight movement of said ball caused by gun movement.

3. The lighting device of claims, wherein the microcontroller to receive and process electrically the outputs of the said motion sensor, comprises:

a digital processor;

a power saving, non-oscillatory 'sleep-mode' and 'wake-up'-mode which minimizes battery drain depending on gun movement by powering down the said electronics of the processor;

use of flicker-noise concepts to efficiently pulse the said electronic light source as an option to DC power if minimal power consumption is required;

oscillator circuit at the operating frequency of 32.768 kHz to avoid detection of an EMI signal; and a negative temperature coefficient therein is or to compensate for the temperature effects on the device battery and said electronic light source.

4. The lighting device of claim 3, wherein the electronic light source which provides the requisite illumination to the muzzle reference system, is a light emitting diode (LED).

5. The lighting device of claim 3, wherein the microcontroller, with its said digital processor, is the Shrink Outline Package (SSOP) PIC16LC558.

* * * * *